US005655241A

United States Patent [19]

Higgins et al.

[11] Patent Number: 5,655,241

[45] **Date of Patent: *Aug. 12, 1997**

[54] SLEEP ENHANCING POSTURIZED MATTRESS AND MATTRESS COVER ASSEMBLY

[75] Inventors: Larry Higgins, Carthage; Earl W. Kennedy, Joplin, both of Mo.

[73] Assignee: L&P Property Management Company, Chicago, Ill.

[ * ] Notice: The term of this patent shall not extend beyond the expiration date of Pat. No. 5,475,881.

[21] Appl. No.: 381,723

[22] Filed: Feb. 1, 1995

Related U.S. Application Data

[63] Continuation-in-part of Ser. No. 237,278, May 3, 1994, Pat. No. 5,475,881, which is a continuation-in-part of Ser. No. 93,384, Jul. 19, 1993, which is a continuation-in-part of Ser. No. 905,085, Jun. 24, 1992, Pat. No. 5,231,717, which is a continuation-in-part of Ser. No. 397,660, Aug. 23, 1989, abandoned.

[51] Int. Cl.[6] ..... A47C 31/02

[52] U.S. Cl. ..... 5/737; 5/499; 5/501

[58] Field of Search ..... 5/470, 471, 499, 5/500, 501, 737–739

[56] References Cited

U.S. PATENT DOCUMENTS

| | | | |
|---|---|---|---|
| 1,892,913 | 1/1933 | Timm | 5/470 |
| 2,399,628 | 5/1946 | Cunningham | 5/470 |
| 2,975,437 | 3/1961 | Freeman | 5/471 |
| 3,287,749 | 11/1966 | Marisco . | |
| 3,504,387 | 4/1970 | Hummel | 5/499 |
| 4,055,866 | 11/1977 | Evans | 5/911 |
| 4,266,307 | 5/1981 | Critelli | 5/470 |
| 4,388,738 | 6/1983 | Wagner | 5/470 |
| 4,463,466 | 8/1984 | May et al. . | |
| 4,662,012 | 5/1987 | Torbet . | |
| 4,726,624 | 2/1988 | Jay | 5/450 |
| 4,922,564 | 5/1990 | Thomas | 5/470 |
| 4,955,095 | 9/1990 | Gerrick | 5/470 |
| 4,961,238 | 10/1990 | Limb et al. | 5/500 |
| 4,982,466 | 1/1991 | Higgins et al. . | |
| 4,999,868 | 3/1991 | Kraft . | |
| 5,117,751 | 6/1992 | Thomas | 5/500 |
| 5,125,121 | 6/1992 | Wroble | 5/499 |
| 5,136,740 | 8/1992 | Kraft | 5/464 |
| 5,263,764 | 11/1993 | Laughlin et al. | 297/440.23 |
| 5,285,542 | 2/1994 | West et al. | 5/500 |
| 5,367,727 | 11/1994 | Dyer, Jr. | 5/470 |
| 5,398,355 | 3/1995 | Bailey | 5/500 |
| 5,457,833 | 10/1995 | Jay | 5/654 |
| 5,459,896 | 10/1995 | Raburn et al. | 5/653 |
| 5,475,881 | 12/1995 | Higgins et al. | 5/470 |

FOREIGN PATENT DOCUMENTS

| | | | |
|---|---|---|---|
| 2579439 | 10/1986 | France | 5/499 |
| 495132 | 12/1951 | Italy | 5/470 |

*Primary Examiner*—Steven N. Meyers
*Assistant Examiner*—Tuyet-Phuong Pham
*Attorney, Agent, or Firm*—Wood, Herron & Evans, L.L.P.

[57] ABSTRACT

A mattress cover assembly for use with a zoned posturized mattress includes a cover with a stretchable top panel and a topper pad, lying generally loosely on the cover top panel. The mattress cover and topper pad are constructed so as to permit the direct application of and distribution of pressure from atop the mattress through the covering topper pad and cover and into the resilient mattress core without significant distortion of that pressure or weight and particularly without distortion which is not only caused by hammocking of the cover fabric or covering pad.

16 Claims, 3 Drawing Sheets

SLEEP ENHANCING POSTURIZED MATTRESS AND MATTRESS COVER ASSEMBLY

This application is a Continuation-In-Part application of application Ser. No. 08/237,278 filed May 3, 1994, which, in turn, is a Continuation-In-Part application of application Ser. No. 08/093,384 filed Jul. 19, 1993, which, in turn, is a Continuation-In-Part application of application Ser. No. 07/905,085 filed Jun. 24, 1992, and now issued as U.S. Pat. No. 5,231,717, which, in turn, is a Continuation-In-Part application of abandoned application Ser. No. 07/397,660 filed Aug. 23,1989.

BACKGROUND OF THE INVENTION

This invention relates to a bedding system, and more particularly, to an improved bedding mattress cover assembly for use with a mattress core for maximizing the restfulness of sleep of a person sleeping atop the mattress.

The quality of a person's sleep and the rest derived from that sleep is dependent upon the comfort of the person reclining atop a sleeping surface, such as a mattress surface. One way in which this comfort can be measured is by the number of movements a person makes over the course of a normal night's sleep. Two factors which have been shown to affect comfort on a mattress are the amounts of pressure applied by the mattress to the body and the support characteristics of the mattress. When a healthy sleeper becomes "uncomfortable", either consciously or subconsciously, they move to relieve the discomfort. This discomfort can come from excessive pressure on the body or improper support from the mattress.

During the night, a healthy person usually goes through approximately four to six sleep cycles. These sleep cycles consist of both REM and non-REM sleep. Non-REM sleep is generally divided into stages I and II, which are light sleep, and stages III and IV which are deep sleep. All levels of sleep are important, but it is during stages III and IV that we get our deepest and most restful sleep.

When a sleeper moves or undergoes a major postural shift, the sleeper arouses to a lighter level of sleep or awakens. If the event of awakening is short in duration, it is often referred to as a transient arousal. The more awakenings and transient arousals which occur in a night or a sleep cycle, the less restful the sleep. Therefore, the more discomfort a sleeper feels during the night, the more that sleeper will move and the more awakenings and transient arousals will occur which will result in less restful sleep.

A perfect mattress, or sleep surface, would eliminate all awakenings or transient arousals associated with discomfort caused by excessive pressure or improper support by the mattress. In fact, sleep studies have shown that when a person is reclining atop a mattress and mattress cover assembly made in accordance with the invention of this application, it will substantially reduce the amount of pressure exerted on the body from the mattress and provide optimum support.

In Torbet U.S. Pat. No. 4,662,012, and in U.S. Pat. No. 4,982,466, there are disclosed multiple zone, constant zone pressure, air mattresses for supporting a person in a reclining position while maintaining minimal supporting body surface pressures. To that end, the mattresses disclosed in both of the above-identified patents utilize zones of differing, but constant air pressure along the length of the mattress, with the pressures in each zone being maintained constant even with body shifts on the mattress. This is in contrast to conventional non-zoned mattresses which maintain a common and constant degree of firmness or resistance to vertical deflection over the whole surface area and for the full length of the mattress, but which change pressures in response to varying loads as a person shifts position on the mattress.

Experimentation has now shown that a mattress should be divided into at least three, and preferably four, longitudinal zones of differing firmness or resistance to vertical deflection in order for the body of a person reclining atop the mattress to be supported with minimal pressures at the high pressure points on the body when lying on either their back or side. This is achievable only when the mattress is divided into at least three, and preferably four, longitudinal zones, each having a different level of resistance to vertical deflection.

But even when a mattress is properly zoned throughout its length, there is a problem of transmitting loads of a person's weight from atop the mattress through mattress covering material to the underlying zone of the mattress core. Typically, mattresses are covered with layers of fibrous matting which are, in turn, covered with an outer layer of material commonly known in the bedding industry as "ticking". The ticking is generally applied in three sections, the sections being a top panel, a bottom panel, and side and end panels. Conventionally, the panels are sewn together on the mattress unit with the top and bottom panels being physically attached to the mattress core.

More recently, the fibrous matting material which was positioned on top of the mattress core has been replaced by unitary pads or so-called "topper pads" of resilient material such as polyurethane foam, sandwiched between quilted layers of woven fabric. Such a mattress topper pad is shown, for example, in U.S. Pat. No. 4,463,466. But whether conventional fibrous pads or topper pads are placed atop the mattress core, there is the problem of transmitting pressures and weights supported by the mattress core from the body of the person resting atop the mattress through to the core without a distortion of those pressures by the ticking or covering material.

The tendency is for the ticking to hammock when supporting a body, which causes the majority of the pressure and weight of a person atop the mattress to be supported from the hammocked ticking. The hammocked ticking creates excessive body surface pressures which cause discomfort and sleep interruptions. This excessive body surface pressure is derived from the hammocked ticking or topper pad because it is carrying a substantial portion of the body weight, and distorts the pressure that the mattress core would experience in the absence of the hammocked ticking or covering material. This pressure distortion occurs even in mattresses which are perfectly zoned, imparting excessive pressure to selected parts on a body resting atop the mattress and thereby disturbing the sleep pattern of the body, It has therefore been an objective of this invention to provide a zoned mattress core and cover assembly which includes a covering material and which is capable of supporting a body with minimal supporting surface pressures at any point on the body.

It has been another objective of this invention to provide an improved zoned mattress core and cover assembly for supporting a person reclining atop the mattress with minimal supporting surface pressures at any point on the body, Still another objective of this invention has been to provide an improved zoned mattress core and cover assembly for enhancing the sleep and minimizing the transient arousals of a person sleeping atop the mattress.

Still another objective of this invention has been to provide an improved mattress cover including a topper pad which increases sleeper comfort and which maintains and thereby enhances posturization of a posturized or zoned mattress core.

SUMMARY OF THE INVENTION

The invention of this application which accomplishes these objectives comprises a mattress cover assembly and a posturized, zoned mattress core which is longitudinally zoned so as to have at least two, and preferably three or four, zones of differing resistance to vertical deflection over the surface of the mattress. The posturized mattress core is covered by a mattress cover assembly including a cover and a topper pad which lies generally loosely on top of the cover. The cover and topper pad are so constructed as to permit the direct application of and distribution of pressure from atop the mattress through the cover and pad and into the posturized core without significant distortion of that pressure or weight, and particularly without distortion which is normally caused by hammocking of the cover fabric or the pad.

One specific mattress cover assembly employed in the practice of this invention comprises a cover to encase the posturized mattress core having side panels, end panels and a top panel connected at its outer edges to the side and end panels. The top panel comprises a stretchable ply of an elasticized fabric which overlies the top or load-bearing surface of the mattress core. This elasticized fabric ply is capable of stretching in at least two mutually perpendicular directions, and preferably capable of being stretched in any direction. The cover assembly further comprises a topper pad which has a generally non-stretchable fabric ply and is configured to lie generally loosely on the mattress cover and core over the stretchable ply. This unique construction of the mattress cover and loose topper pad enables the generally non-stretchable top fabric pad to fold inwardly when a load or force is applied atop the mattress cover while the elasticized fabric stretches.

In one embodiment, the topper pad is loose and preferably not held or restricted at its sides or its ends but is only held in position atop the mattress core by elasticized cover bands which fit beneath the corners of the mattress core. Thereby, load or weight is transferred through the cushioning topper pad and cover into the posturized mattress without the cover or pad imparting any support to the load or weight. As a result, there is no hammocking of the covering materials relative to the mattress core and there is no high body surface pressure imparted to the body by hammocked ticking or covering material. Thus, the posturizing of the mattress core and the comfort of the mattress is maintained by the cushioning covering materials rather than being impaired or effectively destroyed by the covering materials.

An alternative embodiment of the present invention comprises a topper pad which is connected to the mattress cover around the corners of the cover such as by sewing, Velcro™, or the like to secure the loose topper pad to the cover. Such securement still maintains a generally loose topper pad and allows the pad to fold inwardly from both the sides and the ends so that substantial hammocking is prevented and a substantial transfer of the mattress load to the side and end panels of the cover is prevented. The posturizing of the mattress core is thereby maintained. In still another embodiment, the topper pad might be secured at its ends to the mattress such as with an accordion pleat. This will maintain a generally loose pad and would prevent hammocking from the sides of the mattress where a majority of the inward folding of the topper pad occurs.

BRIEF DESCRIPTION OF DRAWINGS

These and other objects and advantages of this invention will be more readily apparent from the following description of the drawings in which.

DESCRIPTION OF PREFERRED EMBODIMENTS

Figure 1:
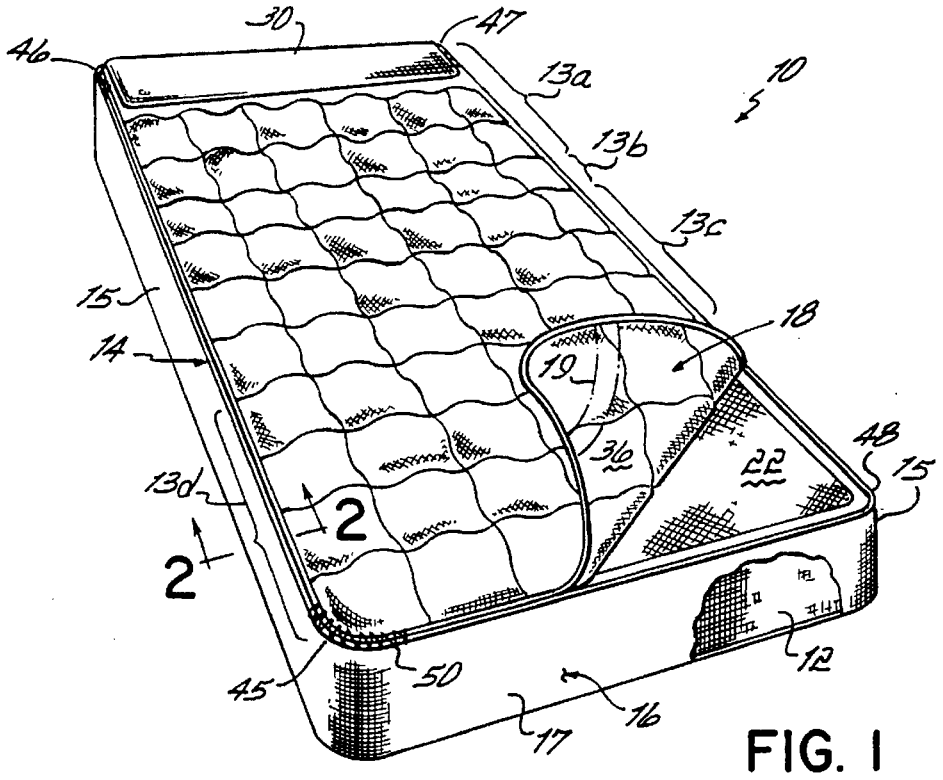
FIG. 1 is a top perspective view of a mattress incorporating the invention of this application.

With reference to the drawings, a mattress 10 embodying the invention of this application, comprises a posturized mattress core 12 and a mattress cover assembly 14 covering core 12. The mattress cover assembly 14 includes a cover 16 which encases core 12 and has padded side panels 15, end panels 17, and an unpadded bottom panel (not shown). The bottom panel may be removably secured to the bottom edges of the side and end panels 15 and 17, respectively, such as by a zipper (not shown) such that the mattress cover 16 may be easily removed from the mattress core 12 to facilitate cleaning of the cover or inversion of the mattress core relative to the cover. Alternatively, the cover 16 might be permanently sewn around the core 12. Cover assembly 14 also comprises topper pad 18 which lies generally loosely on top of cover 16 and core 12 as illustrated in FIG. 1.

The mattress core 12 may be an air mattress core such as disclosed in U.S. Pat. No. 4,982,466, or it may be a foam mattress core, or it may be a metal spring mattress core. But in any event, whether made as a fluid filled bladder-type mattress core, or a foam mattress core, or a metal spring mattress core, it is posturized and is therefore longitudinally divided into at least two, and preferably three or four, longitudinal zones (not shown) of differing firmness characteristics.

For example, the zones in a four-zone core would be of four different firmnesses (i.e., resistance to vertical deflection). As illustrated in FIG. 1, these four zones comprise an upper body zone 13*a*, a waist zone 13*b*, a hip zone 13*c*, and a leg or foot zone 13*d*. The zones 13*a*–*d* of the mattress core 12 are of substantially differing firmness with the waist zone 13*b* being substantially more firm than the other zones. The upper body zone 13*a* (supports head and shoulders) is the next most firm. The hip zone 13*c* is the next most firm, and the leg zone 13*d* is the least firm. The hip and leg zones will hereinafter be referred to collectively as the lower body zone. If the mattress core 12 is a spring core, these differing firmnesses of the differing zones of the mattress result from springs of differing characteristics within each of the zones. These differing firmnesses may be the result of differing gauge wire utilized to manufacture the springs in each zone or of differing styles of coils. Alternatively, the springs may be made of differing composition wire.

If the mattress core 12 is a foam mattress core in which the resiliency of the mattress is imparted by the resiliency of the foam material, then differing firmness foam materials are utilized in the differing zones to achieve the same relative firmness as is achieved by the springs described hereinabove. Or as yet another alternative, the differing firmness zones may be achieved by differing pressures in an air mattress as described in U.S. Pat. No. 4,982,466.

Whether the zoned mattress core 12 is a spring mattress or a urethane foam mattress or an air mattress or some other type of mattress core, it should ideally be at least seven inches, and preferably, eight inches in height and sufficiently soft and pliant that it will allow an average man (approximately 5' 9" in height and 160 pounds in weight) or an average woman (approximately 5' 3" in height and 120 pounds in weight) to sink as much as five inches into the mattress core at the deepest point of penetration when lying on their side. Thereby, a person reclining atop the mattress sinks into the mattress to a sufficient depth to maximize the area over which the body is supported and thereby minimizes the surface pressure imparted to the body at any point on the body by the mattress. Further, detail regarding a suitable posturized mattress core 12 for use in the present invention is provided in application Ser. No. 08/237,278 filed May 3, 1994 , U.S. Pat. No. 5,475,881 which is incorporated by reference herein in its entirety.

The invention of this application incorporates a unique mattress cover assembly 14, including a unique loose topper pad 18 on the top surface of the mattress core 12. The cover 16 of the cover assembly 14 is so constructed as to permit the transfer of forces from the top of the mattress through the topper pad 18 into the mattress core 12 with a minimum of interference by the covering materials on the mattress core and a minimum transfer of load or pressure laterally of the core or from one zone to another longitudinally. The topper pad 18 is not completely attached to the mattress core 12 but is only held in place atop the core by elasticized corner bands 19 which stretch beneath the corners of the core 12 to hold the topper pad 18 cover in place. Alternatively, the corners of the pad 18 may be sewn at its edges to the edges of the side and end panels 15, 17, respectively as illustrated in FIG. 1.

Figure 2:
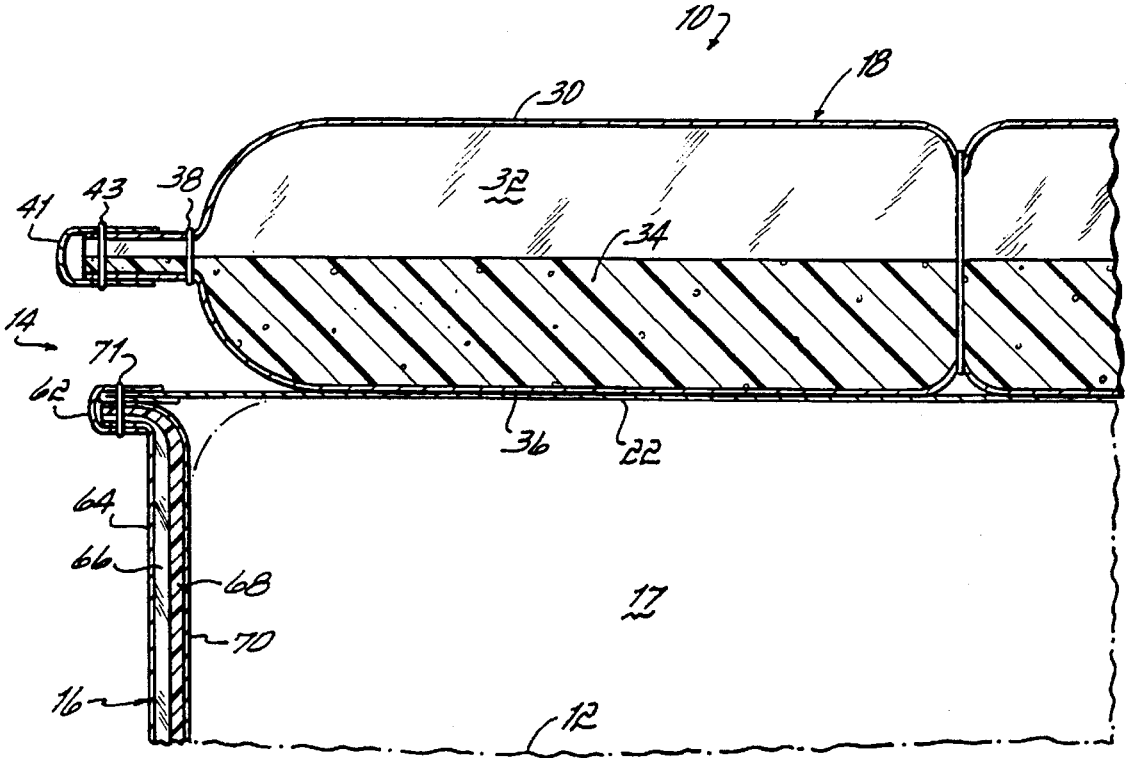
FIG. 2 is a cross sectional view taken on line 2—2 of FIG. 1.

With particular reference now to FIGS. 1 and 2, it will be seen that the mattress cover 16 comprises a top panel 22. The top panel 22 includes a ply of an elasticized fabric which is constructed to be stretchable in at least two mutually perpendicular directions, and in the preferred embodiment, is capable of being stretched in any direction. As a consequence of this construction, and as explained more fully hereinafter, the mattress cover 16 and stretchable top panel 22 enable the non-stretchable ticking and scrim of the topper pad 18 to fold inwardly when a load or force is applied to the top of the mattress cover 16, while the elasticized fabric of panel 22 stretches. Thereby, compression of the cover 16 can be localized atop the mattress cover 16 without causing hammocking of the covering materials or the topper pad, which hammocking would result in lateral and longitudinal redistribution of the load or force applied to the top of the mattress 10. As a result of this construction of the cover, the function of the posturized mattress core 12 and the overall comfort of the mattress 10 is maintained and enhanced by the covering materials rather than being impaired or effectively destroyed by those covering materials.

As shown in FIG. 2, one embodiment of the topper pad 18 comprises a top ply of conventional woven ticking material 30, a second ply of non-woven batting material 32, a third ply of urethane foam 34, and a fourth ply of backing scrim material 36. The top ticking layer 30 is preferably a conventional decorative fabric material. In the preferred embodiment, the second ply is a non-woven batting of polyester fibers, but this second layer could as well be a soft urethane or other foamed plastic material. Alternatively, the second and third ply could be a single ply of cushioning urethane foam material. The bottom ply 36 of backing scrim material may be either a woven or unwoven material. It functions solely as a backing to facilitate quilting of the topper pad 18. These four plies are sewn together approximately 1" inwardly from the outer edge of the materials by a sewn seam 38. The exposed edge outside of this seam 38 is hidden by a decorative tape or covering material 41 which is held by seam 43. The covering tape 41 is a decorative tape which functions solely to cover the outer edge of the topper pad 18.

Each of the side panels 15 and end panels 17 comprise a decorative woven fabric outer ply 64, a thin second inner ply 66 of non-woven fabric batting material, a third relatively thin ply of urethane foam material 68, and an innermost ply of woven or unwoven scrim material 70. A seam 71 passes through all four of these plies and through the edge of elastic top panel 22 at the top edge of the side 15 and end panels 17 so as to secure all four of those plies to the elastic top panel 22 and create a complete cover 16 to encase mattress core 12. The bottom panel (not shown) is a single ply of woven or non-woven material which simply functions to hold or secure the mattress cover 16 over the mattress core 12.

The topper pad 18, in accordance with the principles of the present invention, lies generally loosely on top of mattress core 12 and cover 16. The topper pad 18 overlies the elastic top panel 22 when positioned properly on mattress 10. In one embodiment of the invention, the topper pad is completely loose from mattress core 12 and cover 16 to allow sufficient indentation of the pad 18 by a resting body. In such a case, a fitted bed sheet or flat bed sheet folded under the mattress would hold the topper pad 18 in place.

Figure 3:
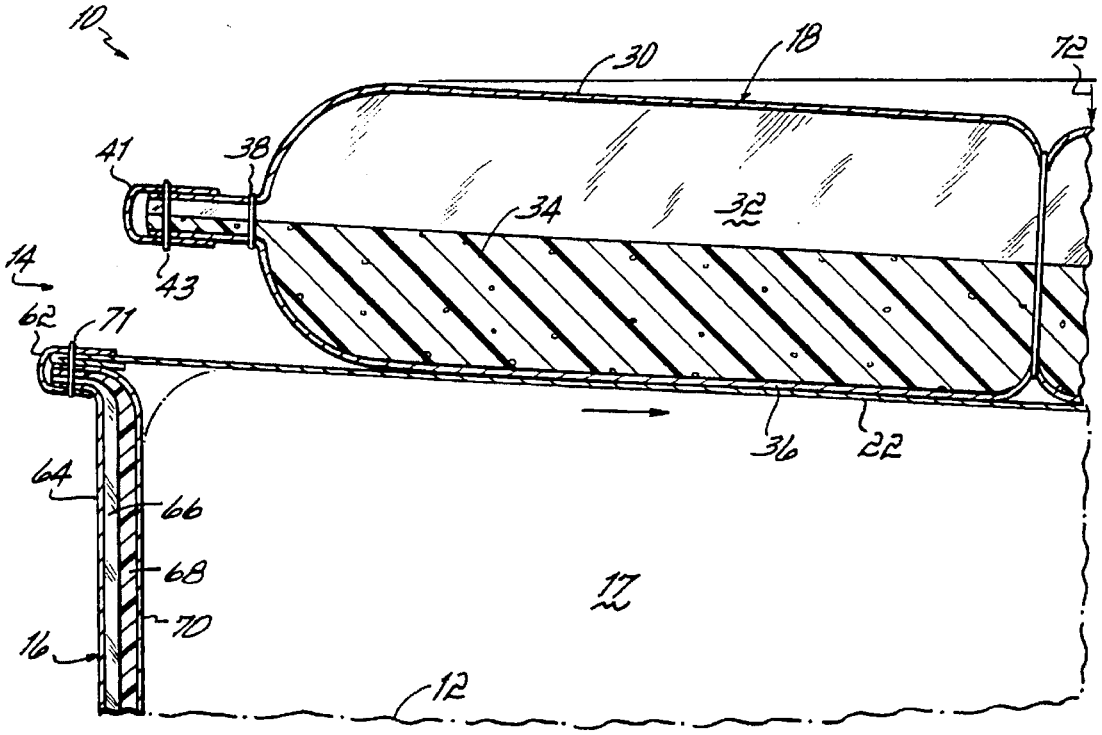
FIG. 3 is a view similar to FIG. 2, but illustrating vertical loading of the mattress such as is imparted to the mattress when a person is reclining atop the mattress.

Alternatively, the topper pad 18 may be connected at chosen points—such as the corners only or one end only—to the core 12 or cover 16 so as to partially secure the pad and effectively reduce lateral or longitudinal movement of the pad on mattress 10. However, in accordance with the principles of the invention, the partially secured topper pad 18 should not be restricted such that indentation of the pad by a body lying on top of the mattress creates substantial hammocking of the side and end panels of the cover. Referring again to FIG. 1, the topper pad 18 may be secured to mattress 10 by bands 19 or by sewing the pad 18 to the corners 45, 46, 47, 48 of the mattress. For such an attachment, the sewed stitches 50 should preferably only extend around the radius of the corner and a few inches to each side of the corner radius as illustrated at corner 45 of FIG. 1. When attached at the corners as such, the topper pad 18 still lies generally loosely on mattress 10 and over elastic top panel 22. A majority of the top, bottom and side edges of the topper pad 18 are loose and may pull inwardly toward the center of the mattress when a body is lying thereon as illustrated in FIG. 3. Other attachment means such as Velcro™ or buttons might be utilized at the corners 45, 46, 47, 48 of topper pad 18 to partially secure the pad to mattress 10.

In a further alternative embodiment, the ends of topper pad 18 might be attached to the corners of the mattress 10, such as by accordion pleats, leaving the sides of pad 18 loose. A majority of the indentation of topper pad 18 from a body lying thereon occurs from the sides of the pad. Therefore, leaving the sides loose and fixing the pad corners to the mattress or mattress cover will allow sufficient indentation into core 12 and will provide comfortable, sleep-enhancing support to a person sleeping on the mattress 10.

Figure 4:
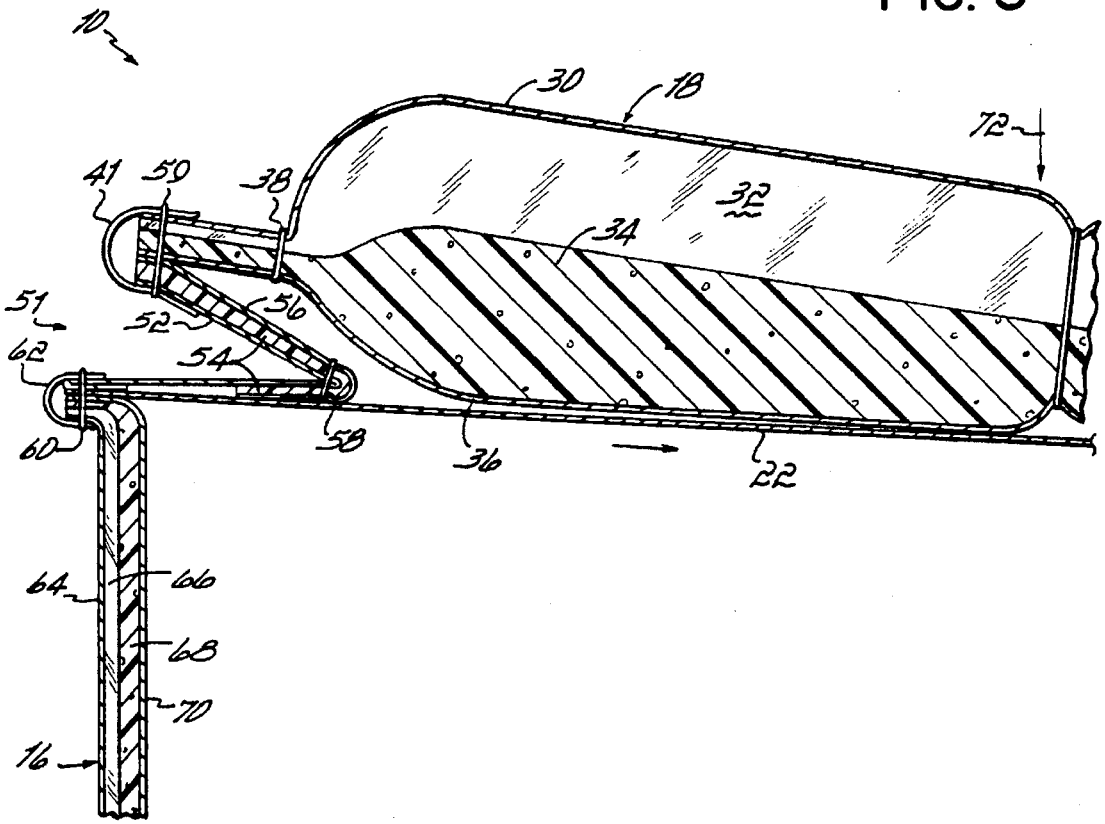
FIG. 4 is a cross-sectional end view of a mattress illustrating securement of the corners of the topper pad to the underlying mattress core by an accordion pleat.

An example of a suitable accordion pleat 51 is illustrated in FIG. 4 attached to a corner of the mattress cover 16 and topper pad 18. The pleat 51 comprises an outer ply of decorative woven material 52 to the inside surface of which there is bonded a thin ply of urethane foam 54. Additionally, there is a scrim tape 56 on the inside of the foam ply. This tape scrim 56 may be either a woven or unwoven fabric. A sewn seam 58 passes through the inner folded edge of the accordion pleat 51 to form the pleat. At the outer upper edge of the accordion pleat 51 a sewn seam 59 passes through the multiple plys of the edge of pad 18 and the plys of pleat 51 to secure the topper pad 18 to the pleat 51. The decorative tape 41 covers the seam 59, At its outer lower edge, the accordion pleat 51 is sewn to the top edge of the end panels 17 by a seam 60. In the embodiment of FIG. 4, seam 60 also connects the elastic top panel 22 of cover 16 to the top edge of the end panel 17 and to pleat 51. This seam 60 also connects a decorative tape 62 to the top edge of the end panels 17 and the outer lower edge of the accordion pleat 51 so as to cover that edge with a decorative material.

With reference to FIG. 3, it will be seen that when the mattress 10 employing the unique cover assembly 14 of this invention is deflected downwardly by a body or force shown by directional arrow 72 acting upon the top of the mattress, that force or pressure will pass through the cushioning mattress topper pad 18 without causing the topper pad or the non-stretchable fabric layers 30, 36 of the pad to hammock and redistribute the downward force on the pad. This occurs because the generally loose topper pad 18 moves downwardly and inwardly and the stretchable elasticized top panel 22 stretches (compare FIG. 2 to FIG. 3). Thereby, there is preferably very little or no lateral or longitudinal displacement of the vertically downwardly directed force from the top of the mattress pad through to the top of the mattress core 12. In this way, the mattress core 12 can be relatively soft so as to allow a person resting atop the mattress to sink into the mattress a substantial distance so as to maximize the surface area of the body to which pressure is applied. Thereby, pressure is evenly distributed over the maximum surface of the body and high pressure points or "hot spots" on the body are minimized or eliminated. As explained hereinabove, this results in a person sleeping atop the mattress being substantially more comfortable and less prone to transient arousals caused by movements necessary to relieve excessive prolonged pressure on selected parts or protuberances of the body.

When the topper pad is fixed to the corners of the mattress such as with sewed seams (see FIG. 1) or with a flexible pleat such as an accordion pleat (see FIG. 4) the results will be generally similar as long as the sides of topper pad 18 are not greatly restricted.

Figure 5:
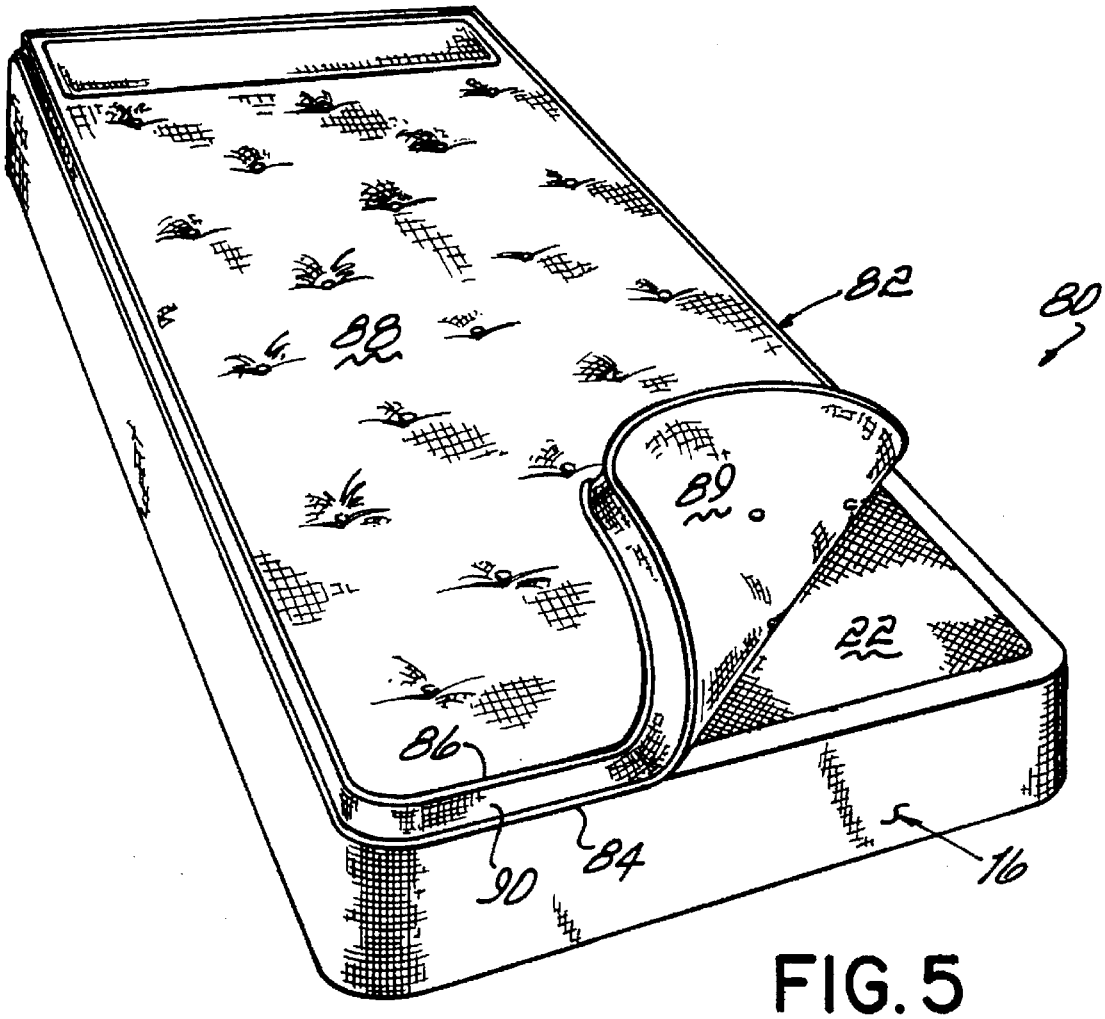
FIG. 5 is a top perspective view of a mattress incorporating an alternative embodiment of the invention of this application.

FIG. 5 illustrates another alternative embodiment of the mattress assembly of the invention. The mattress 80 utilizes a mattress core (not shown), similar to core 12, with a mattress cover 16 having a top panel 22 of elasticized fabric capable of being stretched in any direction in accordance with the principles of the present invention. The topper pad 82 of mattress 80 is loose and rests on the top panel 22 such that forces from the top of the mattress are directed through the topper pad 82 into the mattress core with a minimum of interferences. Preferably, the topper pad 82 is not attached to the mattress core or mattress cover 16 in any way and lies completely loose on the top of panel 22 as shown in FIG. 5. Topper pad 82 is constructed somewhat similarly to the topper pad 18 of FIG. 2. However, topper pad 82 has a double edge comprising parallel, spaced seams 84 and 86 which are sewn and covered by decorative tape similar to seam 38 of FIG. 2. The parallel seams 84, 86 connect the coextensive upper ply 88 and lower ply 89 of pad 82 together with a side panel ply 90. The completely loose topper pad 82 in combination with panel 22 ensures that mattress pressure from a body is evenly distributed over the mattress to produce a more restful sleep.

While the present invention has been illustrated by the description of the embodiments thereof, and while the embodiments have been described in considerable detail, it is not the intention of applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of applicants' general inventive concept. The claims are:

We claim:

1. A posturized mattress for enhancing sleep by minimizing pressure points on the body of a person sleeping atop the mattress, the mattress comprising:

an elongated posturized mattress core having at least two longitudinally spaced zones of differing firmness;

a mattress cover encasing said core, said cover comprising side panels, end panels and a top panel connected at its outer edges to the side and end panels, said top panel having an elasticized ply which is stretchable in at least two mutually perpendicular directions;

a generally loose top pad comprising a non-stretchable fabric ply, the top pad lying on said mattress cover over the elasticized top panel, the top panel being sufficiently stretchable and the top pad being sufficiently loose that a load on top of said top pad may substantially depress said top pad and mattress cover top panel without substantial hammocking of said top pad and without transferring an appreciable load to said side and end panels of said mattress cover;

an accordion pleat coupled at an end thereof to at least one point around a perimeter of the mattress cover and coupled at another end thereof to said generally loose top pad to loosely couple the top pad with the mattress core at said one point.

2. The mattress of claim 1 wherein said top panel elasticized ply comprises a ply of elasticized fabric material.

3. The mattress of claim 1 wherein the top pad includes a second ply comprising a layer of unwoven material.

4. The mattress of claim 1 wherein the generally loose top pad is coupled with the mattress core at a plurality of points around the perimeter of said cover.

5. The mattress of claim 4 wherein the cover is rectangular and top pad is coupled with the mattress core proximate at least two corners of the cover.

6. The mattress of claim 1 wherein said generally loose top pad is coupled with said mattress core proximate opposing ends of the mattress cover.

7. The mattress of claim 1, wherein said top pad includes at least one elastic band positioned proximate a corner of said top pad, said band being stretchable to be placed over a corner of said mattress core to secure said top pad to the core corner.

8. The mattress of claim 1 wherein the mattress core is at least seven inches in height and sufficiently soft and pliant so as to permit a person sleeping atop the mattress to sink substantially into the core at the point of deepest deflection so as to minimize pressure applied by the mattress to the body.

9. The mattress of claim 1 wherein said mattress core has at least four longitudinally spaced zones of differing firmness, said zones comprising in sequential order progressing from one longitudinal end thereof, an upper body support zone, a waist support zone, a lower body support zone and a leg support zone, said waist support zone being the most firm of said zones and said leg support zone being the least firm.

10. A mattress cover assembly for covering a resilient posturized mattress core having at least two longitudinally spaced zones of differing firmness, the mattress cover assembly comprising:

a cover to encase the mattress core and having side panels, end panels and a top panel connected at its outer edges to the side and end panels, said top panel having an elasticized ply which is stretchable in at least two mutually perpendicular directions; and a top pad having a generally non-stretchable fabric ply, the top pad configured to lie generally loosely on a mattress core and on said mattress cover over the elasticized top panel, the top panel being sufficiently stretchable and the top pad being sufficiently loose such that a mattress load on top of said top pad may substantially depress said top pad and mattress cover top panel into the core without substantial hammocking of said top pad and without transferring an appreciable load to said side and end panels of said mattress cover;

an accordion pleat coupled at an end thereof to at least one point around a perimeter of the mattress cover and coupled at another end thereof to said generally loose top pad to loosely couple the top pad with the mattress core at said one point.

11. The mattress cover assembly of claim 10 wherein said top panel stretchable ply comprises a ply of elasticized fabric material.

12. The mattress cover assembly of claim 10 wherein the top pad includes a second ply comprising a layer of unwoven material.

13. The mattress cover assembly of claim 10 wherein the generally loose top pad is coupled with the mattress core at a plurality of points around the perimeter of said cover.

14. The mattress cover assembly of claim 13 wherein the cover is rectangular and the top pad is coupled with the mattress core proximate at least two corners of the cover.

15. The mattress of claim 10 wherein said top pad is coupled with said mattress core proximate opposing ends of the mattress cover.

16. The mattress cover assembly of claim 10 wherein said top pad includes a second ply, the first and second plies being generally coextensive, one on top of the other, and connected together by a side ply, the first ply and second plies connecting to said side ply by parallel, spaced seams.

* * * * *

UNITED STATES PATENT AND TRADEMARK OFFICE

CERTIFICATE OF CORRECTION

PATENT NO. : 5,655,241

DATED : August 12, 1997

INVENTOR(S) : Larry Higgins and Earl W. Kennedy

It is certified that error appears in the above-identified patent and that said Letters Patent is hereby corrected as shown below:

In Column 10, line 7, delete "stretchable" and insert --elasticized--.

Signed and Sealed this

Tenth Day of March, 1998

*Attest:*

*Attesting Officer*

BRUCE LEHMAN

*Commissioner of Patents and Trademarks*